US005151038A

United States Patent [19]

Range et al.

[11] Patent Number: 5,151,038

[45] Date of Patent: Sep. 29, 1992

[54] ADAPTER FOR CONTACT RAILS

[75] Inventors: Helmut Range, Lemgo; Gerhard Beigel, Detmold; Friedemann Lotsch, Dortmund; Peter Debie, Unna, all of Fed. Rep. of Germany

[73] Assignee: Staff GmbH & Co. KG, Lemgo, Fed. Rep. of Germany

[21] Appl. No.: 691,851

[22] Filed: Apr. 26, 1991

[30] Foreign Application Priority Data

Apr. 30, 1990 [DE] Fed. Rep. of Germany ..... 4013863

[51] Int. Cl.[5] ..... H01R 25/14

[52] U.S. Cl. ..... 439/122; 439/117

[58] Field of Search ..... 439/121, 122, 259, 261, 439/263, 529, 532, 533, 116, 117, 119; 191/23 A

[56] References Cited

U.S. PATENT DOCUMENTS

Re. 24,647 5/1959 Logan ..... 439/259

4,861,273 8/1989 Wenman et al. ..... 439/111

4,915,656 4/1990 Alferness ..... 439/809

*Primary Examiner*—Gary F. Paumen

*Attorney, Agent, or Firm*—Pollock, Vande Sande & Priddy

[57] ABSTRACT

An adapter for a contact rail having electrical conductors and grooves provided on opposite surfaces thereof including a housing including, two lateral legs forming a recess therebetween and moveable away from each other between an open and a closed position. Electrical contacts are provided in the housing at the opposite sides of the recess and positioned for engaging with electrical conductors of the contact rail with the contact rail placed between the legs in the closed positon. At least one of the lateral legs can be moved along a straight line into a closed position such that holding elements provided on the legs engage grooves on the contact rail and the electrical contacts engage the electrical conductors of the contact rail.

22 Claims, 1 Drawing Sheet

ADAPTER FOR CONTACT RAILS

FIELD OF THE INVENTION

The present invention refers to an adapter for making electrical contact with rails.

BACKGROUND OF THE INVENTION

In the prior art adapter of this type, two legs of the adapter are linked through a swivel and are pressed against each other under spring tension, in a manner similar to that of clothespins. The contacts engage the conductors of the embraced contact rail under spring tension. An essential disadvantage of this known adapter lies in the fact that it is not secured against unintentional displacement, since retention is achieved solely through spring force. Furthermore, the fact that the electrical contacts also represent the mechanical holding elements has proven to be a disadvantage.

SUMMARY OF THE INVENTION

The present invention adapter is designed such that it can be secured in its working position against unintentional displacement and is provided with separate electrical contact elements and mechanical holding elements.

The disadvantages of the prior art are overcome by the structure of the present invention adapter in which at least one leg of the adapter is movable in a straight line and can be secured against displacement at the point where the electrical contacts engage the conductors of the contact rail in the closed and locked position, and when holding elements engage recesses of the contact rail.

The adapter according to the present invention has the advantage that it is secured against becoming unintentionally detached from the contact rail. Moreover, it can be connected to the contact rail with very accurate fit such that very precise coordination is provided between the adapter and the contact rail when they are connected.

BRIEF DESCRIPTION OF THE DRAWINGS

A preferred embodiment of the present invention is described below with reference being made to the accompanying drawings, wherein.

DETAILED DESCRIPTION OF THE PREFERRED EMBODIMENT(S)

Figure 1:
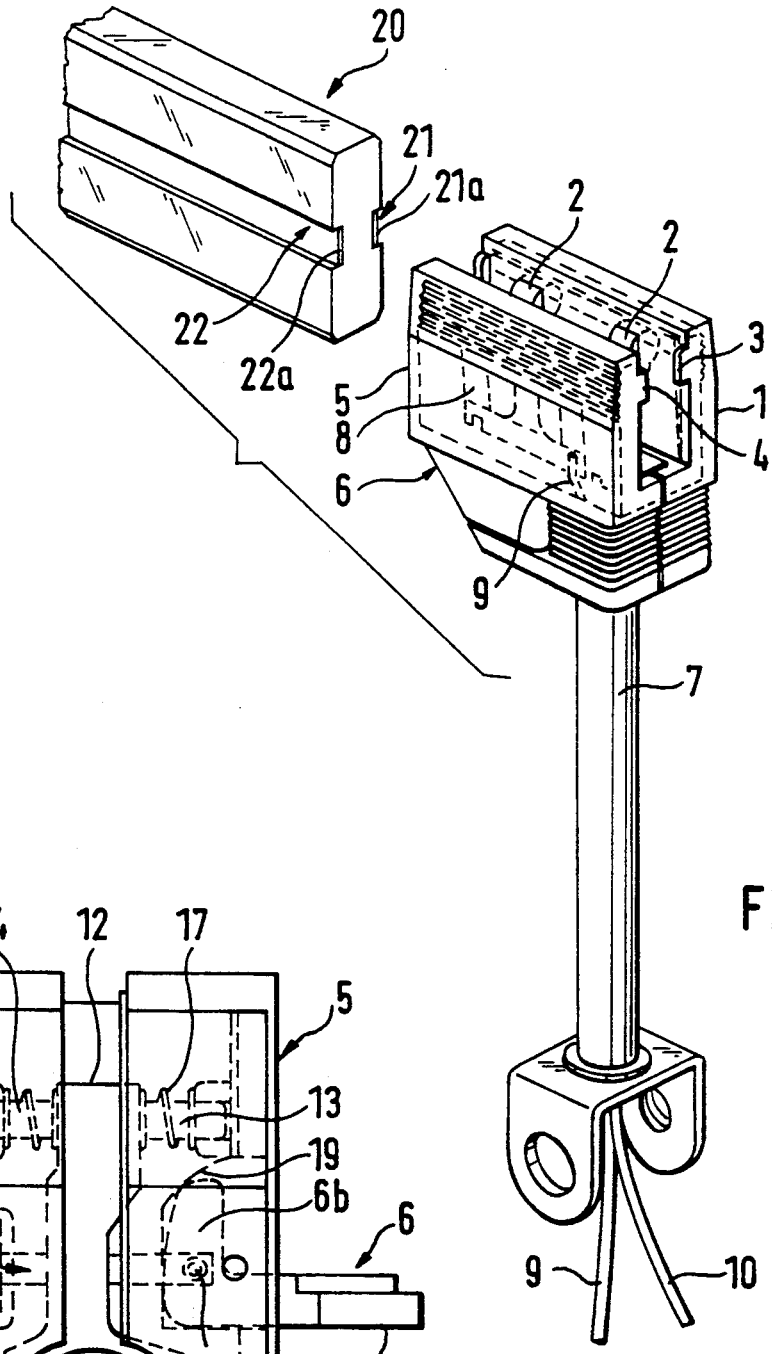
FIG. 1 shows a perspective view of the adapter in a locked position with of a part of a cooperating contact rail withdrawn therefrom.

The adapter has an elongated, metallic base part 12 which is provided with two guide pins 13 and 15 attached on one side and two guide pins 16 and 14 attached on the other side. The lower ends of two legs 1 and 5 are guided by the guide pins as they move towards or away from the central part of the adapter. The guide pins are surrounded by springs 17 which press the two legs 1 and 5 apart with the adapter in an open position.

Figure 2:
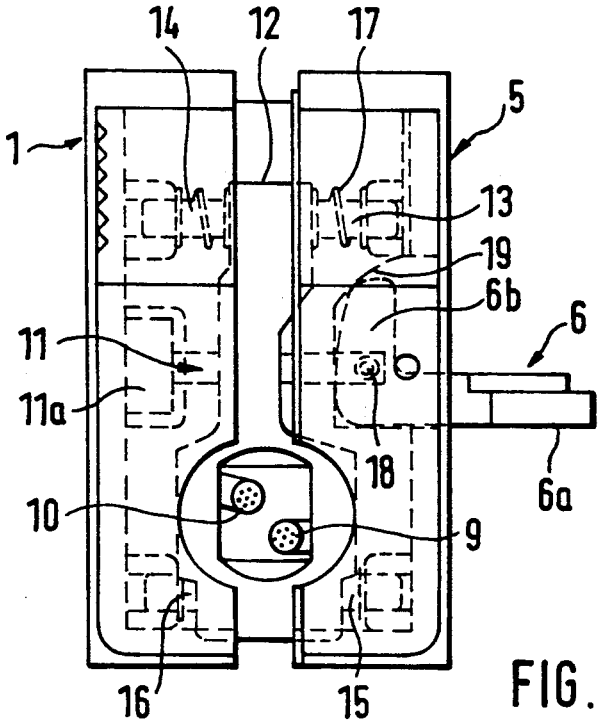
FIG. 2 shows a view of the adapter according to FIG. 1 from below and with the supporting member being removed.

From the opened position shown in FIG. 2, the legs 1 and 5 can be brought into the closed and locked position shown in FIG. 1. In the closed and locked position, the electric contacts 2, which are arranged in both legs

1 and 5 at the same height, engage conductors 21*a* and 22*a* of the contact rail 20. The conductors are arranged in receiving grooves 21 and 22 on the contact rail. The holding studs 3 and 4, which are provided in both legs on both front sides, in the closed position, engage the receiving grooves 21 and 22. In this engaged position, in which the electrical contacts 2 also engage the electrical conductors 21*a* and 22*a*, the adapter is secured with the help of a stop lever 6.

The stop lever locks the adapter in the closed position with the help of a set bolt 11 which has a head 11*a* that is firmly connected to the leg 1. The set bolt 11 penetrates the base part 12 and can freely slides sideways in a through-hole. At the end of the bolt away from the head 11*a*, the stop lever 6, designed as a toggle lever, is pivotally attached to the set bolt 11 by the tightening pin 18 forming an axis of rotation about which the toggle lever rotates. The tightening pin penetrates the side 6*b* of the stop lever and rests in a crosswise hole of the shaft of the set bolt 11. The stop lever 6 has, in addition to the double-angled side 6*b*, an outer angle activation surface 6*a* to which force is applied to move the adapter into a closed and locked position. When the toggle lever 6 is moved from the open position shown in FIG. 2 into the closed position in FIG. 1, the double-angled side 6*b* runs downwardly along a sloping surface 19 of the leg 5, running eccentrically to the swivel axis. In this way, the two legs 1 and 5 are drawn together by the set bolt 11, overcoming the force of the springs 17, moving into the closed position shown in FIG. 1.

The electrical contacts 2 are on corresponding contact supports 8 to which conductors 9 and 10 are soldered. The conductors 9 and 10 pass through a conduit 7 which bears at its lower end an element supporting a light. The holding conduit 7 is not shown in FIG. 2 in order to provide a better illustration.

While a preferred embodiment of the present invention has been illustrated and described, it will be appreciated that various changes can be made therein without departing from the spirit and scope of the present invention.

We claim:

1. An adapter for a contact rail having electrical conductors and grooves provided on opposite surfaces thereof, said adapter comprising:

a housing including, two lateral legs forming a recess therebetween and moveable away from each other between an open and a closed position;

electrical contacts provided in said housing at the opposite sides of said recess and positioned for engaging with the electrical conductors of the contact rail with said contact rail placed between the legs in said closed position of said adapter; and holding elements provided on said legs;

wherein at least one said leg can be moved along a straight line relative to the other leg into said closed position, such that the electrical contacts engage the electrical conductors of the contact rail and said holding elements engage the grooves on the contact rail.

2. An adapter according to claim 1, wherein the lateral legs are slidably guided along a straight line and can be secured in said closed position.

3. An adapter according to claim 1, wherein said housing further includes a base part including at least two lateral guide pins on which the lateral legs rest and upon which the lateral legs slide into said closed position.

4. An adapter according to claim 1, further including a set bolt which is connected to a first of said lateral legs, penetrates the base part, and slidably rests therein, said set bolt protruding into a second of said lateral legs and bearing a stop lever pivotally attached to said set bolt by a pin, said first lateral leg including an eccentric sliding surface upon which said stop lever rides.

5. An adapter according to claim 4, wherein said stop lever is a toggle lever which includes on an angle side, an activation surface which, with the adapter in a closed position, lies substantially parallel to an outer surface of the second lateral leg, said stop lever also including, connected to said activation surface, an angle side which runs along the sliding surface of said second lateral leg as the adapter is moved into a closed position and lies substantially perpendicular to an outside surface of said second lateral leg with the adapter in a closed position.

6. An adapter according to claim 1, wherein said legs are substantially made of plastic.

7. An adapter according to claim 1, wherein said legs are maintained in an opened position by springs.

8. An adapter according to claim 3, wherein said base part is metallic and connected to a conduit.

9. An adapter according to claim 1, wherein said holding elements are holding studs which are designed to engage said grooves on the contact rail.

10. An adapter according to claim 9, wherein said holding studs and the electrical contacts are arranged at the same level.

11. An adapter for a contact rail having electrical conductors and grooves provided on opposite surfaces thereof, said adapter comprising:

a housing with two lateral legs forming a recess therebetween and each leg including an inside surface facing toward said recess, said legs being moveable away from and towards each other between an open and a closed position and adapted to be slidably and removably mounted to the contact rail placed in said recess;

at least two electrical contacts located in said recess of said housing, each said contact situated adjacent to a respective one of said legs, said electrical contacts facing said recess, at least one holding element projecting from each said inside surface toward said recess, wherein with said adapter in said closed position, said holding elements engage grooves on said contact rail and said electrical contacts touch electrical conductors arranged in said grooves.

12. An adapter according to claim 11, wherein said adapter further comprises a conduit with a first and a second end, said first end attached to said base part, said second end attached to an element supporting a light.

13. An adapter for a contact rail having electrical conductors and grooves provided on opposite surfaces thereof, said adapter comprising:

a housing with two lateral legs forming a recess therebetween and each leg including an inside surface facing toward said recess, said legs moveable away from and towards each other between an opened and a closed position and adapted to be slidably and removably mounted on the contact rail, electrical conducting means located on opposite sides of said recess, means for supporting said adapter on said contact rail, wherein with said adapter in said closed position, said supporting means engage grooves on said contact rail and said conducting means touch electrical conductors arranged in said grooves.

14. The adapter according to claim 13, wherein said adapter includes means for guiding and maintaining in an open position said lateral legs including at least two guide pins attached on opposite sides of said base part and facing said lateral legs, said guide pins each surrounded by a spring and being inserted in a respective passage in said lateral legs.

15. The adapter according to claim 13, wherein said supporting means comprises, on each of said lateral legs, an inside surface facing toward said recess of said housing and at least one holding element projecting from said inside surface toward said recess of said housing.

16. The adapter according to claim 13, wherein said electrical conducting means comprises at least two electrical contacts located in said central portion of said housing, one situated adjacent to each of said legs, said electrical contacts facing said central portion of said housing.

17. An adapter according to claim 13, wherein said adapter further includes on said base part at least two lateral guide pins on which the lateral legs rest and upon which guide the lateral legs slide into the closed position.

18. An adapter according to claim 13, further including a set bolt which is connected to a first of said lateral legs, penetrates the base part, and slidably rests therein, said set bolt protruding into a second of said lateral legs and bearing a stop lever pivotally attached to said set bolt by a pin, said first lateral leg including an eccentric sliding surface upon which said stop lever rides.

19. An adapter according to claim 18, wherein said stop lever is a toggle lever which includes on an angle side, an activation surface which, with the adapter in a closed position, lies substantially parallel to an outer surface of the second lateral leg, said stop lever also including, connected to said activation surface, an angle side which runs along the sliding surface of said second lateral leg as the adapter is moved into a closed position and lies substantially perpendicular to an outside surface of said second lateral leg with the adapter in a closed position.

20. An adapter according to claim 13, wherein said legs are substantially made of plastic.

21. An adapter according to claim 13, wherein said legs are maintained in an open position by springs.

22. An adapter according to claim 13, wherein said base part is connected to a conduit.

* * * * *